US006510654B1

(12) United States Patent
McCracken

(10) Patent No.: US 6,510,654 B1
(45) Date of Patent: Jan. 28, 2003

(54) LOCKING MECHANISM FOR A WINDOW GUARD SYSTEM

(76) Inventor: Robert S. McCracken, 4377 N. Baldwin Ave., El Monte, CA (US) 91731

( * ) Notice: Subject to any disclaimer, the term of this patent is extended or adjusted under 35 U.S.C. 154(b) by 1 day.

(21) Appl. No.: 10/011,412

(22) Filed: Dec. 11, 2001

(51) Int. Cl.[7] ..... F06B 3/68
(52) U.S. Cl. ..... 49/67; 49/50
(58) Field of Search ..... 49/50, 55, 56, 49/61, 62, 67, 323; 292/67, 68, 147, 150, 295

(56) References Cited

U.S. PATENT DOCUMENTS

| | | | | | |
|---|---|---|---|---|---|
| 4,019,281 | A | * | 4/1977 | Weiler | 49/56 |
| 4,070,048 | A | * | 1/1978 | Young | 292/179 |
| 4,771,269 | A | * | 9/1988 | Pasty et al. | 340/545 |
| 5,018,302 | A | * | 5/1991 | Kluge | 49/56 |
| 5,934,020 | A | | 8/1999 | Mc Cracken | |
| 6,061,961 | A | * | 5/2000 | Rupe | 49/164 |
| 6,192,628 | B1 | * | 2/2001 | Pinheiro et al. | 49/70 |
| 6,422,287 | B1 | * | 7/2002 | Wilke | 160/92 |

OTHER PUBLICATIONS

Ⓐ, McCracken, Robert, Dec. 11, 2001, Instructions on how to use the instant invention.

* cited by examiner

*Primary Examiner*—Jerry Redman
(74) *Attorney, Agent, or Firm*—Tom Hamill, Jr.

(57) ABSTRACT

A locking mechanism for a window guard system is disclosed. The window guard is mounted about the exterior of a window to its frame. The window guard is designed to be have the capability to be opened from the inside. A locking mechanism with three lock subassemblies is provided. A first locking element includes a sliding rod which immobilizes the second lock. The second locking element includes a position dependent sliding member which secures the third lock. The third lock is a pin which must be appropriately rotated in order to be removed when the second locking element is slid to a specific position. At this point, after opening the three locks comprising the locking mechanism, the window guard may be opened by pushing on the now released side causing rotation about the hinge members on the other side. The locking mechanism must be opened in a specific order in order to open the window guard. Once the window guard has been opened, one may egress the building or clean the window or window guard assembly.

14 Claims, 6 Drawing Sheets

LOCKING MECHANISM FOR A WINDOW GUARD SYSTEM

RELATED PATENTS

U.S. Pat. No. 5,934,020 has the same sole inventor as the instant application (patent) and is hereby incorporated herein by reference.

BACKGROUND OF THE INVENTION

1. Field of the Invention

The present invention relates to locking mechanisms for window guard systems. Window guards cover windows and prevent unauthorized access amongst other things.

2. Description of the Prior Art

U.S. Pat. No. 5,934,020 issued to McCracken describes a window guard and lock. The instant invention has a new and unique locking system which would discourage unwanted entry, yet permit a person in the home the ability to disengage the locking system and egress from the structure, home of building. The new window guard system incorporates improvements mainly in the locking mechanism. The structural and physical differences of the new window guard system will be made apparent from the following description thereof.

SUMMARY OF THE INVENTION

The present invention is a locking mechanism for a window guard system. A window is covered by the window guard. Many window guards are permanently affixed, and in case of emergency, exiting through a window so protected would not be possible. The invention herein contemplates a locking mechanism accessible to a person inside the home, building or structure. This locking mechanism may be opened by such a person, permitting the window guard to be opened from within the home. The window guard opens by rotating the main body of the window guard about a set of J-shaped pins located on a first side. For the record, the term home includes a building, a structure, an apartment, a domicile, a basement, an attic or any other window to which the window guard is affixed thereto.

The window guard is mounted about the exterior of a window. The window guard is designed to prevent any access from the outside to the inside through the window. Provisions are made to secure the window guard to the frame surrounding the window. These securing means are of sufficient quality to deter the removal of the window guard from the outside of the window short of extraordinary means.

However, the window guard may be opened from the inside by an authorized person. This may be done to effect an emergency egress, such as in the case of a fire. It may also be done to more easily clean the window. Additionally, sometimes it may be desirable to have the window opened with the window guard not impairing the view. For these and other reasons, it is desirable to have the capability to open the window guard.

The window guard has a three lock mechanism which is employed to secure the window guard in a secure and locked position. The three lock mechanism is mounted on the interior of the second portion of the locking plate. The left side of the first extension bracket is received in an opening defined by the three lock mechanism and the interior of the third portion of the locking plate.

The three lock mechanism basically comprises a rectangular channel with an upper portion and a lower portion. The channel is secured to the locking plate on the inside of the window guard. The upper portion of the channel is open and the lower portion of the channel is closed. A first end plate is provided at the intersection of the upper portion and the lower portion. At the rear of the first end plate is a first slot or groove. At the top of the upper portion of the channel is a second end plate, parallel to the first end plate. At the rear of the second end plate is a second slot or groove, in a direct linear relation with the first slot or groove.

A first locking element resides in the channel. It is adapted to slide up and down in the channel and resides in the first slot or groove. The top portion of the first locking element is the grasping portion which is integral with and perpendicular to the remainder of the first locking element. The grasping portion is a rectangular plate designed to rest atop the first end plate. The grasping portion may be grasped and slidingly moved in the upper portion of the channel from the first end plate to the second end plate. The lower portion of the first locking element is generally an elongated rectangle. It has a slot which runs down the center of the lower portion. When the first locking element is slid from one position to another, the slot travels upward and downward as well. On the slot is an arcuate cutout. The arcuate cutout is located in the closed lower portion of the channel. In the front of the closed lower portion of the channel and in the rear of the closed lower portion of the channel is an aperture, each aperture in direct linear alignment. These two apertures are also in direct alignment with an aperture located on the first extension bracket. These three apertures in linear alignment are designed to receive a key there through, securing the first extension bracket in the locking plate.

The second slot or groove is designed to receive an elongated rectangular element there through which would rest atop the grasping element of the first locking element. This may be termed the second locking element. It disables the ability of the first locking element to slide in the upper open portion of the channel as well as the lower closed portion of the channel.

When the second locking element is removed, the first locking element can slide up and down between the boundaries established by the upper portion of the open channel. There is one position when the arcuate cutout on the slot is in alignment with the aperture on the front of the closed channel, the rear of the closed channel and the first extension bracket. The key fits through all of these apertures and secures the first extension bracket to the locking plate. The key has a portion which extends through the front of the lower portion of the channel. The key further includes a portion which fits in the slot of the first locking element, which permits the first locking element to slide freely up and down. The key cannot be withdrawn until the first locking element slides to the precise position where the arcuate cutout is in alignment with the other apertures. The first locking element cannot slide at all when the second locking element is engaged. The key may be considered the third locking element. The third locking element includes other provisions to prevent it from being casually removed, these other provisions will be discussed in the detailed description of the invention.

At this point, after opening, actuating or deactivating the three locking elements comprising the locking mechanism, the window guard may be pivotally opened by rotation about the hinge members. As discussed, the locking mechanism must be opened in a specific order in order to open the window guard. Once the window guard has been opened, one may egress the building or clean the window or window guard assembly. By simply reversing the process, the window guard may be secured about the outside portion of the window.

The metallic and inter fitting elements of this invention may be protected against oxidation by appropriate treatment of anti-rust compositions.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a window guard which may be opened from the inside of the home, once the window has been opened, permitting emergency egress from the building.

It is therefore an object of the present invention to provide a window guard which may be opened from inside of the home once the window has been opened, to permit the cleaning, repair or replacement of the window.

It is an object of the present invention to provide a locking mechanism which must be unlocked before the window guard may be opened.

It is an object of the present invention to provide a locking mechanism with three separate locking subassemblies.

It is an object of the present invention to provide a window guard which is easy to install about a window on its window frame, using removal resistant fasteners or other means to mount the locking plate on the first side and the hinges on the second side to prevent their removal.

It is an object of the present invention to provide a window guard which has a pleasant appearance, but which at the same time prevents access to the locking mechanism from outside the window.

It is an object of the present invention to provide a window guard which is of strong and durable construction and discourages illegal entry.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a locking mechanism for a window guard system embodying the principles and concepts of the present invention will be described.

Figure 1:
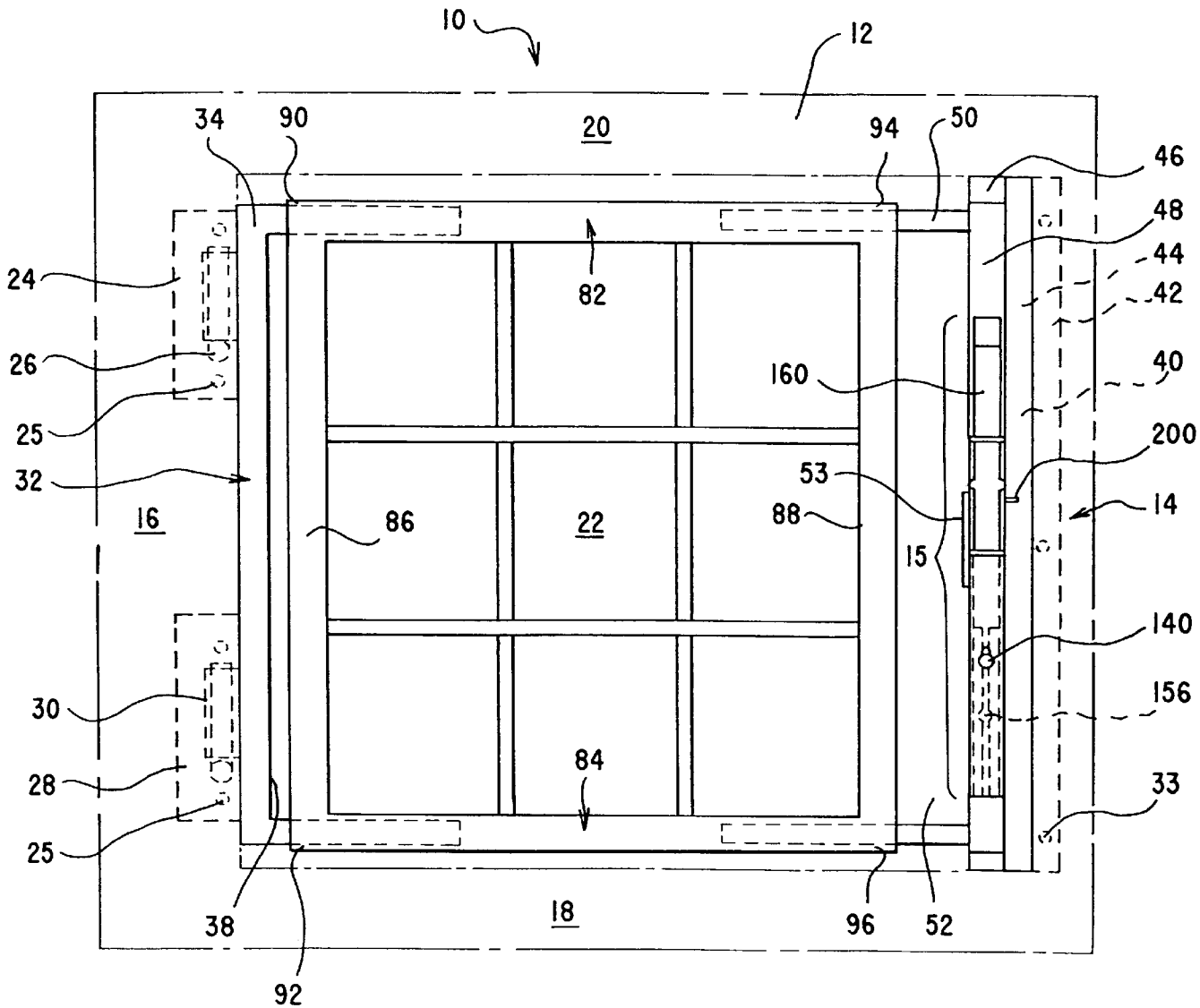
FIG. 1 is a view of the locking mechanism and the window guard system as seen from inside the home.
Figure 2:
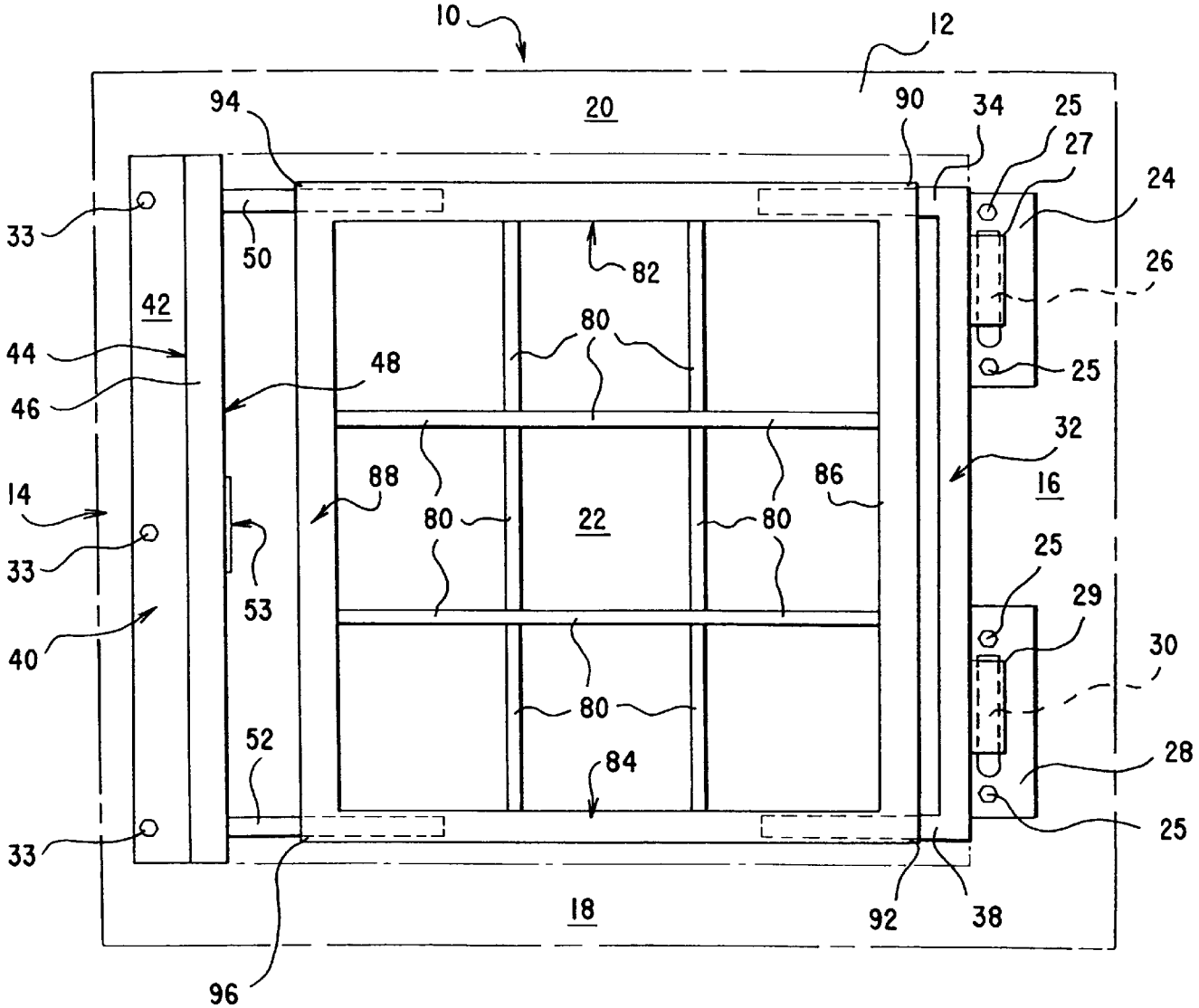
FIG. 2 is a view of the locking mechanism and the a window guard system as seen from outside the home.
Figure 3:
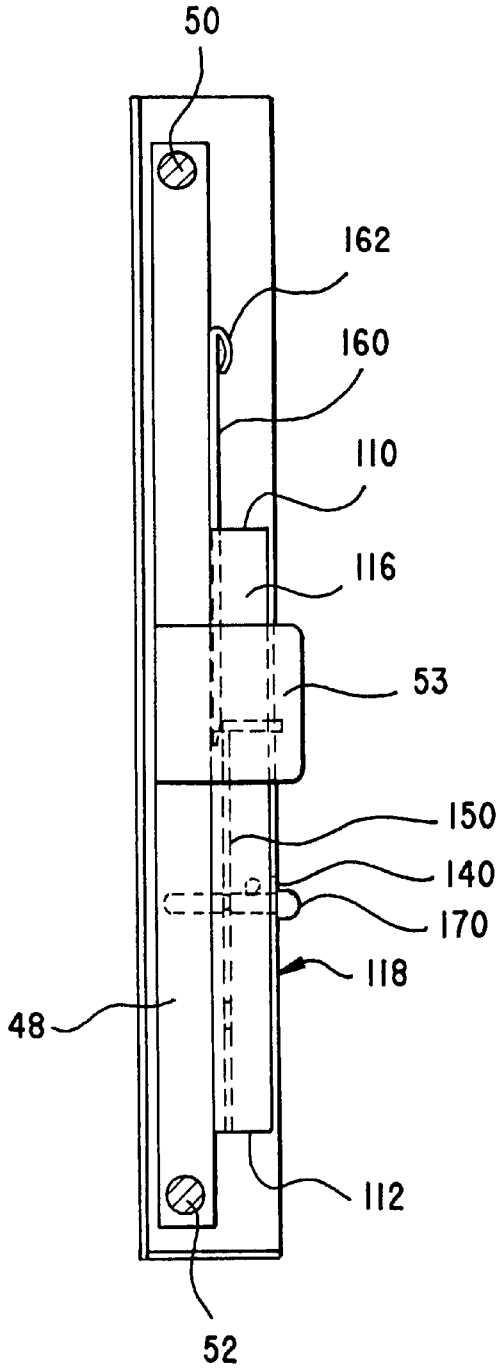
FIG. 3 is a side view of the locking mechanism 15 shown in FIG. 1.

Turning initially to FIGS. 1 and 2 a view of the locking mechanism for a window guard system 10 is shown. FIG. 1 is a view from inside the home looking out. FIG. 2 is a view from outside the home looking in.

The locking mechanism for a window guard system 10 is mounted on the outside of window frame 12. To access the window guard locking mechanism 15 from the inside, the window 22 must be open. One is not able to access the window guard locking mechanism 15 from the outside.

The window frame includes a first side 14, a second side 16, a bottom side 18, and a top side 20.

The second side 16 of the window frame 12 includes a top hinge 24 with a top J-shaped element 26 and a bottom hinge 28 with a bottom J-shaped element 30. The hinges (24, 28) are mounted in a linear fashion, one over the other, the top (first) hinge 24 proximal the top of the second side 16 of the window frame 12 and the bottom (second) hinge 28 proximal the bottom of the second side 16 of the window frame 12. The hinges (24, 28) would be secured to the outside window frame 12 by a first plurality of mechanical fasteners 25. These mechanical fasteners 25 may be chosen to be any of a variety of screws, nails or the like. It would be preferable if the mechanical fasteners 25 would be of the type which would resist removal once they are inserted.

A first extension bracket 48 generally has an elongated C-shaped configuration. The first extension bracket 48 has a left side 54, a top side 50 and a bottom side 52. The left side 54 is intermediate the top side 50 and the bottom side 52. A handle 53 is located on the first extension bracket 48 on the left side 54. The handle 53 is located proximal the midpoint of the length of the left side 54. The first extension bracket 48 has a first side 47 and a second side 49. The handle 53 is secured to the first side 47. The extension bracket 48 further has a third side 46 and a fourth side 51. The third key or pin receiving aperture 100 is located on the fourth side 51. This secures the first extension bracket 48 to the locking mechanism in an area proximal the locking plate 40. The slot 154, the second key receiving aperture 146 and the first key or pin receiving aperture 140, and the key or pin 170 will be described in further detail in the description of the locking mechanism.

A second extension bracket 32 generally has an elongated C-shaped configuration. The second extension bracket 32 has a first side 38, a top side 34 and a bottom side 36. The first side 38 of the second extension bracket 32 is intermediate the top side 34 and the bottom side 36. Further, the top side 34 is perpendicular to the top end of the first side 38 and the bottom side 36 is perpendicular to the bottom end of the first side 38. The first side 38 has a first hollow cylindrical element 27 and a second hollow cylindrical element 29 secured thereon. The top J-shaped element 26 is slidingly engaged in the first hollow cylindrical element 27. The bottom J-shaped element 30 is slidingly engaged in the second hollow cylindrical element 29. This permits the second extension bracket 32 and all it attached to, to have the capability to rotate or pivot about the J-shaped elements (26, 30) when the locking mechanism is disabled.

A locking plate 40 is secured to the first side 14 of the outside window frame 12. The locking plate 40 would be secured to the first side 14 of the outside window frame 12 by a second plurality of mechanical fasteners 33. These mechanical fasteners 33 may be chosen to be any of a variety of screws, nails or the like. It would be preferable if the mechanical fasteners 33 would be of the type which would resist removal once they are inserted. The first plurality of mechanical fasteners 25 and the second plurality of mechanical fasteners 33 may be chosen to be the same or to be different. If the fastener types were different it may offer greater resistance to tampering or the like.

Figure 4:
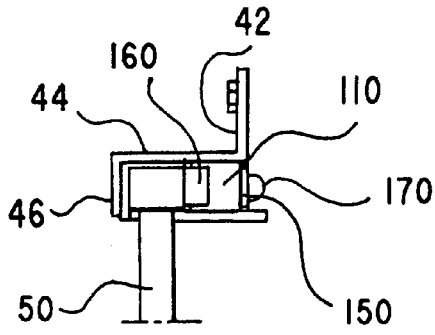
FIG. 4 is a top view of the locking mechanism as shown in FIG. 3.
Figure 5:
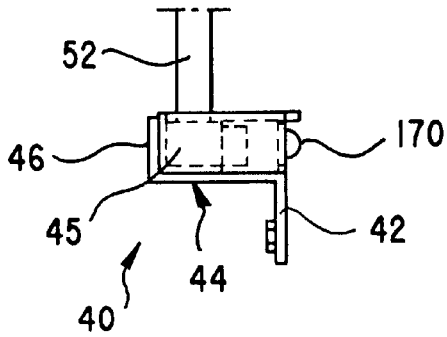
FIG. 5 is a bottom view of the locking mechanism as shown in FIG. 3.
Figure 6:
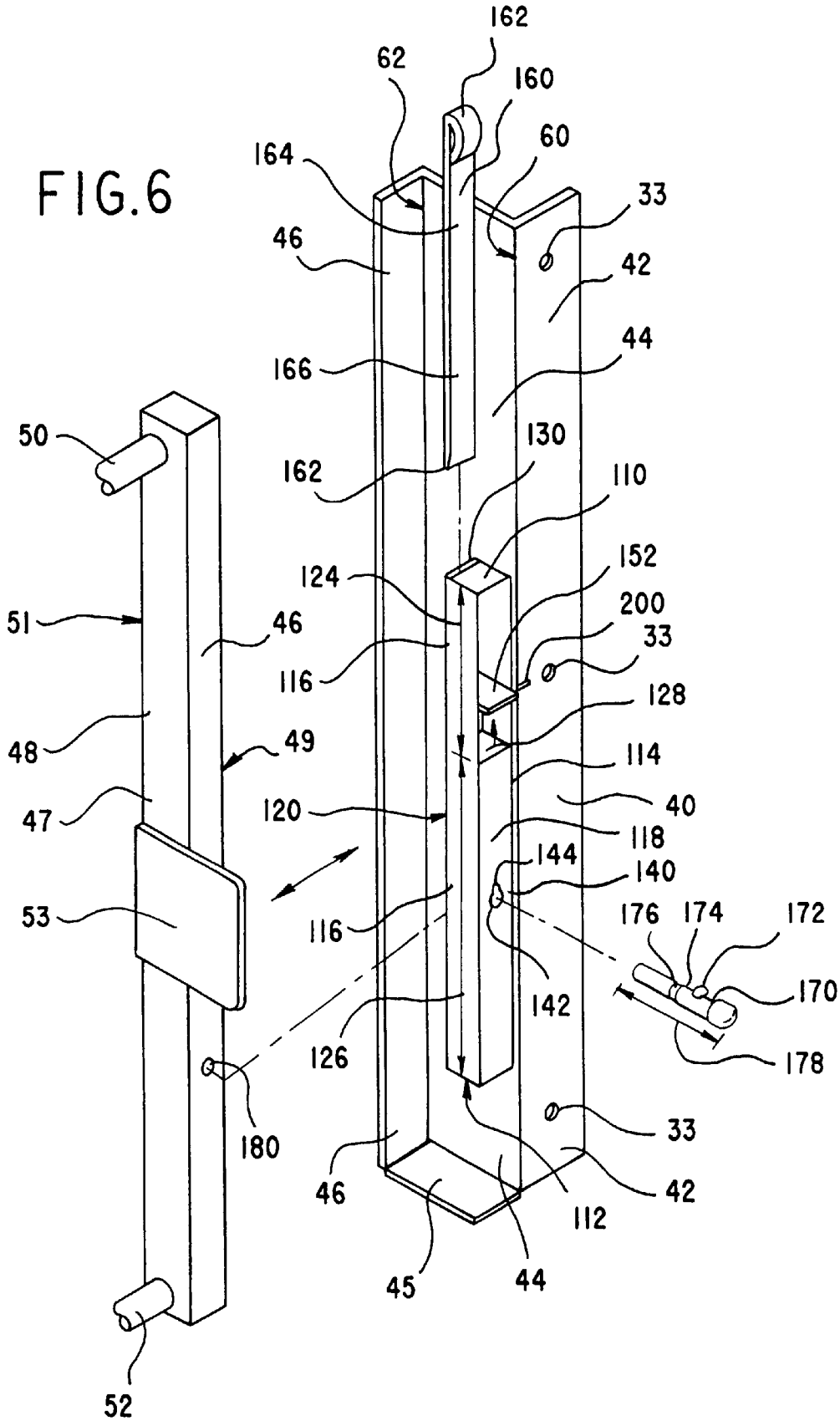
FIG. 6 is a partial view showing the locking mechanism and the first extension bracket.
Figure 7:
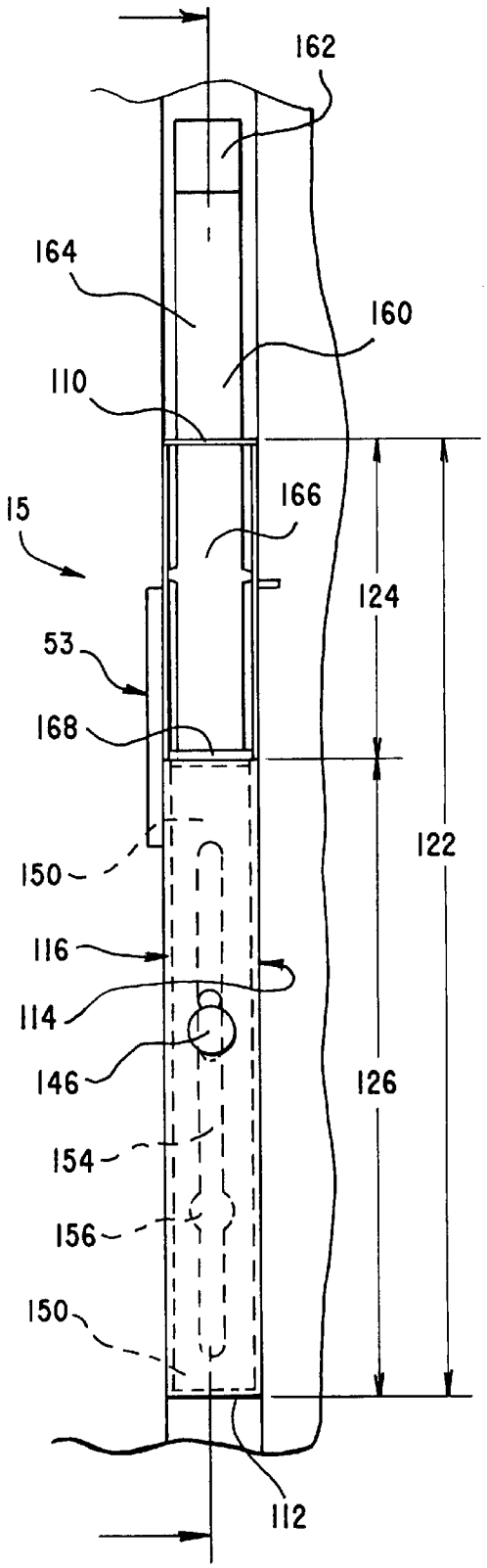
FIG. 7 is a front view of the locking mechanism.

The locking plate 40 is a single piece of metal with a first bend 60 and a second bend 62 in it. The first portion 42 is secured to the first side 14 of the outside window frame as described in the previous paragraph. The second portion 44 is perpendicular to the first portion 42 about the first bend 60. The first portion 42 and the second portion 44 are the same length (ie: they traverse from the top side 20 of the outside window frame 12 to the bottom side 18 of the outside window frame 12) and are about the same width. The third portion 46 of the locking plate 40 is perpendicular to the second portion 44 of the locking plate 40 about a second bend 62. The third portion 46 of the locking plate 40 is parallel to the first portion 42 of the locking plate 40. The first portion 42 of the locking plate 40 and the third portion 46 of the locking plate 40 although parallel extend in exactly the opposite direction from each other and the second portion 44 from the first bend 60 and the second bend 62 respectively. This arrangement can be seen in FIG. 4 when viewing the locking plate 40 from the top. At the bottom of the intersection of second portion 44 and the third portion 46 is a plate 45. Plate 45 is horizontal, forming a bottom. The bottom side 52 of the first extension bracket 48 can slide on to and off of plate 45 when the locking mechanism 15 is completely released.

The main guard 80 has a first side 86, a second side 88, a top side 82 and a bottom side 84. The central area of the main guard 80 has a protective configuration. The protective configuration may be bars forming a lattice, bars disposed closely in a horizontal relationship, bars disposed closely in a vertical relationship, bars disposed closely in any of a plurality of angular dispositions, bars forming an ornamental device which prevents entry (such as that shown in the Figures of U.S. Pat. No. 5,934,264), or another arrangement for preventing access to the window from the outdoor. Closely is defined as close enough together to protect the window and the access thereto from the outside of the home. The central area of the main guard 80 is shown forming a lattice in FIGS. 1 & 2.

The main guard top side 82 has a first aperture 90 on the first side and the main guard top side 82 has a second aperture 92 on its second side.

The main guard bottom side 84 has a third aperture 94 on the first side and the main guard bottom side 84 has a fourth aperture 96 on its second side.

The first extension bracket top side 50 slidingly interfits in the first aperture 90. The first extension bracket bottom side 52 slidingly interfits in the second aperture 92. This permits the first extension bracket 48 to be slid to any of a variety of positions within the apertures (90, 92) located on the main guard first side 86. This allows the window guard to be adapted to fit any of a variety of windows as well.

The second extension bracket top side 34 interfits in the third aperture 94. The second extension bracket bottom side 36 interfits in the fourth aperture 96. The permits the second extension bracket 32 to be slid to any of a variety of positions within the apertures (94, 96) located on the main guard second side 88.

Now turning to the rest of the figures, the locking mechanism 15 and its function and relation to the rest of the invention is shown. Inside the left or first side of the window frame 14 is the locking plate 40. The locking plate 40 has the locking mechanism 15 secured thereto. The locking mechanism 15 is secured to the interior of the locking plate 40, which is only accessible from the inside once the window 22 is open. The locking mechanism 15 is secured to the locking plate 40 somewhere about the midpoint between the top and bottom of the locking plate 40. The locking mechanism 15 would be secured to the second portion 44 of the locking plate 40. The locking mechanism 15 is secured to the second portion 44 of the locking plate 40 by any of a variety of means including mechanical fasteners or welding. This description of the orientation of the locking mechanism 15 with respect to the locking plate 40 on the window guard 10 will be better seen in the figures. The locking mechanism 15 includes several subassemblies which gives the mechanism three individual locking devices which must be disabled before the window guard can open by pivoting on the J-shaped elements (26, 30) located on the pair of hinges (24, 28).

The locking mechanism 15 is a generally rectangular channel with a top side 110, a first side 114, a second side 116, a front side 118, a back side 120 and a bottom side 112. The channel 122 has an upper portion 124 and a lower portion 126. The upper portion 124 is open, ie the upper portion 124 does not have a front side. The lower portion 126 is closed, we: the lower portion does have a front side 118. The upper portion 124 is separated from the lower portion 126 by a first end plate 128 which is parallel to both the top side 110 and the bottom side 112. The top side 110 has a first groove 130 proximal the back side 120. The first end plate 128 has a second groove 132 proximal the back side 120. The first groove 130 is in linear alignment with the second groove 132. The first groove 130 and the second groove 132 extend generally from the first side 116 to the second side 114.

Figure 8:
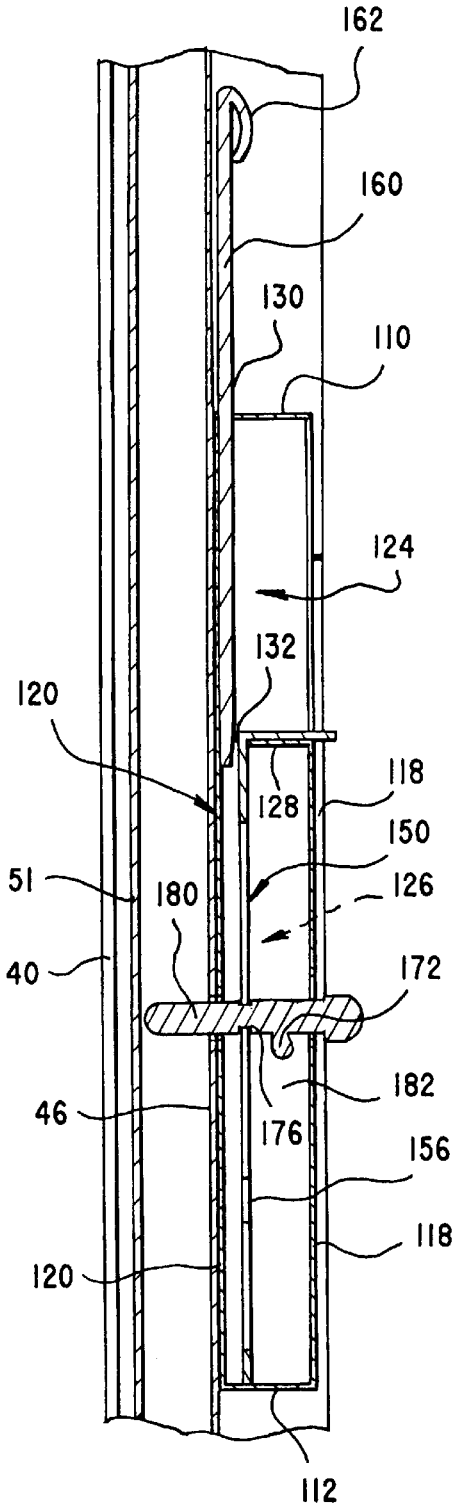
FIG. 8 is a cutaway view of the locking mechanism showing the key in the secured location.
Figure 9:
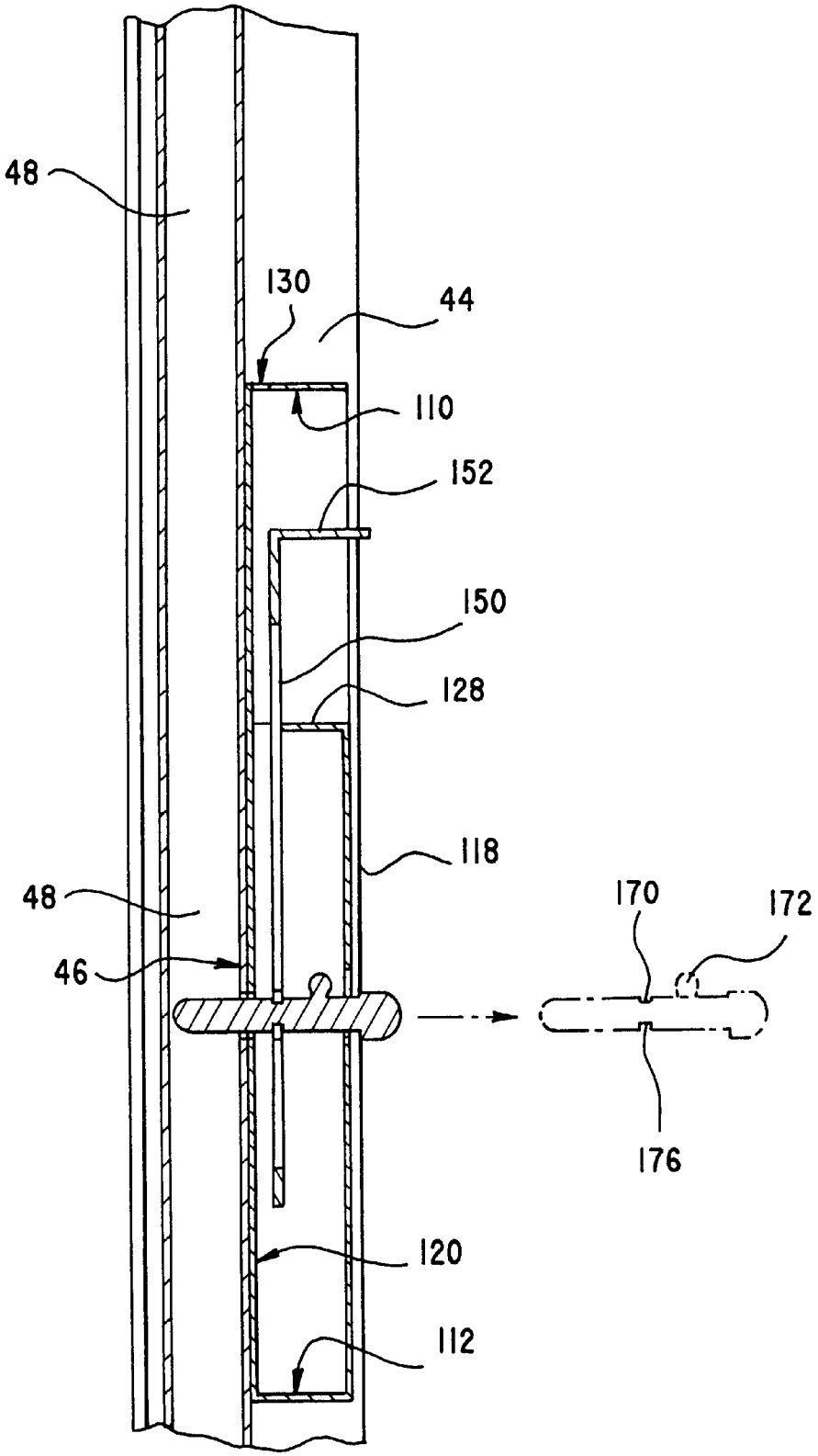
FIG. 9 is a cutaway view of the locking mechanism showing the internal arrangement to permit the removal of the key.

The front side 118 of the channel 122 has a first opening 140 generally centrally located thereon. The first opening 140 has a lower circular opening 142 with a first larger diameter mated with an upper circular 144 opening with a second smaller diameter giving the first opening the appearance of a "Figure 8". The back side 120 of the channel 122 has a second opening 146 generally centrally located thereon, the second opening 146 has a circular opening with a first larger diameter identical to and in direct linear relation to the first opening first larger diameter.

An elongated first tongue 150 is slidably received in the second groove 132, the first tongue 150 having a second end plate 152 which is perpendicular to the remainder of the first tongue 150 and when not acted upon rests atop the first end plate 128. The elongated first tongue 150, when the second end plate 152 is at rest atop the first end plate 128, substantially transits the lower portion 126 of the channel 122. The elongated first tongue 150 has a slot 154 which is centrally located on the first tongue 150 and has a length equal to about that of the lower portion 126 of the channel 122. An arcuate cutout 156 is located at a precise position along the slot 154. Although the figures do not give exact dimensions, they give approximate dimensions, which will give one a sense of the length of the slot 154, the location of the arcuate cutout 156 and the proportion of the upper portion 124 of the channel 122 to the lower portion 126 of the channel 122. The second end plate 152 may be grasped and moved in a sliding fashion until it intersects the top side 110 of the channel 122. Therefore, the first tongue 150 may slide the length of the upper portion 124 of the channel 122, having the effect of moving the slot 154 and thus the arcuate cutout 156 located thereon the same length in the lower portion 126 of the enclosed channel 122.

An elongated second tongue 160 is slidably received in the first groove 130. The second tongue 160 has a top 162, top portion 164, a bottom portion 166 and a bottom 168. The bottom 168 of the second tongue 160, when inserted fully through the first groove 130 rests atop the second end plate 152. This has the action of locking the first tongue 150 in place, forcing the second end plate 152 to maintain its position in contact with the first end plate 128. When inserted, the bottom portion 166 of the second tongue 160 is in the upper portion 124 of the channel 122, and the top portion 164 of the second tongue 160 is above the top side 110 of the locking mechanism 15. The top 162 of the second tongue 160 has a grasping element 162 designed to be grasped for removal and insertion through the first groove 130 and the upper portion 124 of the channel 122.

The locking mechanism also includes a key 170. The key 170 is an elongated generally cylindrical shaft with a first diameter, it includes a bulb 172 on a top portion 174 and a cutout portion 176 along the shaft 178. The key 170 is inserted through the front side 118 "figure 8" opening 140, passes through the arcuate cutout 156 on a precise position on the slot 154 of the first tongue 150, passes through the second opening 146 on the back side 120 and then passes into the final opening 180 on the first extension bracket 48. This secures the first extension bracket 48 in place with the bottom side 52 or the first extension bracket 48 resting on the horizontal plate 45, located on the bottom of the locking plate 40. The cutout portion 176 of the key 170 rests in the slot 154 and permits the second tongue 160 to slide up and down about the key 170. The bulb 172 on the top portion 174 of the key 178 resides in the area 182 intermediate the slot 154 of the first tongue 150 and the front side 118. As mentioned, the first tongue 150 may slide up and down after the second tongue 160 has been removed. When the second tongue 160 has been removed, the first tongue 150 is lifted to a certain point. This is the point where the arcuate cutout 156 is located on the slot 154 on the first tongue 150. This point is designated as the "sweet spot" 200. This permits the key 170 to slide through the slot 154 because the cutout portion 176 is riot longer retained in the slot 154. The key 170 is pulled back and rotated to align the bulb 172 with "figure 8" opening (140, 142, 144) and to remove key 172 in its entirety when the bulb portion when properly aligned with the "figure 8" opening 140. At this point, the first extension bracket 48 may be slid toward the main guard, releasing the bracket 48 from the locking plate 40. And then the entire window guard 10 may pivot open about the second side 16. The entire window guard 10 may be pulled vertically upward and taken off of the J-shaped elements completely (26, 30). One may do this to install storm windows, clean the windows thoroughly or just to enjoy the view.

It is apparent from the above that the present invention accomplishes all of the objectives set forth by providing a new and improved window guard system with a locking mechanism which permits a user to open the window guard while maintaining the security of the structure.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently 20 deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A locking mechanism for a window guard system, said window guard secured on a first side of an exterior frame of a window and said window guard pivotally mounted on a second side of an exterior of a window frame, said locking mechanism comprising:

a mounting means for said locking mechanism, said mounting means adapted to be affixed proximal said first side of the window, a key, said key removably affixed to said window guard, a vertical channel, said vertical channel including a first vertical sliding member with a slot centrally located thereon, said slot further including a circular cutout at a point thereon, said key passing through said slot, said first vertical sliding member preventing removal of said key unless specifically aligned with said circular cutout, whereby when said vertical sliding member is moved vertically to align said circular cutout with said key, said key may be removed, permitting said window guard to be opened about said first side while pivoting about said second side.

2. A locking mechanism for a window guard system as claimed in claim 1 wherein said vertical channel includes an upper portion and a bottom portion, said upper portion separated by said bottom portion by a horizontal element, said vertical channel further includes a first side, a second side, a bottom side, a top side, a back side and a front side, said front side extends from said bottom side to said horizontal element.

3. A locking mechanism for a window guard system as claimed in claim 2 wherein said horizontal element includes a first thin slot proximal said back side, said first thin slot adapted to receive said first vertical sliding member therein, and said first thin slot further permits said first vertical sliding member to slide intermediate said horizontal element and said top side.

4. A locking mechanism for a window guard system as claimed in claim 3 wherein said first vertical sliding member has a top side, said top side includes a horizontal portion perpendicular to first vertical sliding member, said horizontal portion parallel to said horizontal element of said channel, wherein when said first vertical sliding member is in its locked position, said horizontal portion rests atop said horizontal member.

5. A locking mechanism for a window guard system as claimed in claim 4 wherein said top side includes a second thin slot proximal said back side, said second thin slot adapted to receive a second vertical sliding member there through.

6. A locking mechanism for a window guard system as claimed in claim 5 wherein said second vertical sliding member has a top portion and a bottom portion, said top portion includes a first grasping element.

7. A locking mechanism for a window guard system as claimed in claim 6 wherein said bottom portion of said second vertical sliding member, when inserted in said second thin slot and in its locked position, rests atop said horizontal portion, preventing said horizontal portion from moving.

8. A locking mechanism for a window guard system as claimed in claim 7 wherein said key is generally cylindrical, has a distal portion and a proximal portion, said key further including a cutout about said cylinder, said cutout adapted to be received in said slot of said first vertical sliding member, permitting said first sliding member to slide up and down.

9. A locking mechanism for a window guard system as claimed in claim 8 wherein said channel front side includes a first aperture, said channel back side includes a second aperture, said window guard first side includes a third aperture, said first, second and third aperture are each adapted to receive said key there through.

10. A locking mechanism for a window guard system as claimed in claim 9 wherein said key has a bulb located atop said cylindrical portion, said bulb intermediate said cutout and said proximal portion, said proximal portion adapted to be grasped, rotated and pulled.

11. A locking mechanism for a window guard system as claimed in claim 10 wherein said first aperture is adapted to permit said bulb to pass through when said bulb is rotated into the correct position, otherwise said first aperture blocks removal of said key.

12. A locking mechanism for a window guard system as claimed in claim 10 wherein said window guard first side includes a top side and a bottom side, said top side having a top rod depending from said top side, said top rod perpendicular to said window guard first side, said bottom side having a bottom rod depending from said bottom side, said bottom rod perpendicular to said window guard first side, said top rod and said bottom rod adapted to be slidingly received in a main portion of said window guard, said main portion of said window guard including structural elements to prevent access to the window.

13. A locking mechanism for a window guard system as claimed in claim 12 wherein said locking mechanism can be disabled and said window guard opened by first removing said second vertical sliding member, second by sliding said second vertical sliding member to said point where said circular cutout is in alignment with said key, third by rotating said key wherein said bulb is in alignment with said third aperture, fourth by removing said key, fifth by sliding said window guard first side into said window guard main portion, and sixth by pushing on said window guard first side causing said window guard main portion to pivotally rotate about said window guard second side.

14. A locking mechanism for a window guard system as claimed in claim 13 wherein said window guard first side, said main portion of said window guard and said window guard second side may be removed from said second side of said window frame.

* * * * *